United States Patent [19]

Lackovic

[11] Patent Number: 5,027,739

[45] Date of Patent: Jul. 2, 1991

[54] DEMOUNTABLE COVER FOR A BOAT HATCHWAY OR THE LIKE

[76] Inventor: Milan S. Lackovic, 424 Patrick Ct., Port Washington, Wis. 53074

[21] Appl. No.: 510,558

[22] Filed: Apr. 18, 1990

[51] Int. Cl.[5] ..... B63B 19/02

[52] U.S. Cl. ..... 114/361; 135/88

[58] Field of Search ..... 114/343, 361, 364, 211; 135/87, 88

[56] References Cited

U.S. PATENT DOCUMENTS

| | | | |
|---|---|---|---|
| 524,137 | 8/1894 | Enright | 114/361 |
| 1,454,220 | 5/1923 | Hall | 114/361 |
| 3,604,440 | 9/1971 | Wilson | 114/361 |
| 4,466,374 | 8/1984 | Katz | 114/361 |

FOREIGN PATENT DOCUMENTS

| | | | |
|---|---|---|---|
| 823723 | 11/1959 | United Kingdom | 114/361 |

*Primary Examiner*—Sherman Basinger
*Assistant Examiner*—Stephen P. Avila
*Attorney, Agent, or Firm*—Andrus, Sceales, Starke & Sawall

[57] ABSTRACT

An easily deployable dodger providing a protective cover for the hatchway on a boat comprises a generally trapezoidal shaped sheet of flexible material, a portion of which is transparent. The sheet is tied by its corners and the midpoint of its base edge to form an aft-opening pyramidal shape with enclosing forward, port and starboard triangular faces. The midpoint of the base forms the apex of the pyramidal shape and the four corners of the trapezoidal sheet define the ends of the lower edges of the three triangular faces. The centrally disposed triangular forward face is formed by tying the corners of the edge opposite the base edge to the boat just forward of the companionway such that the lower edge extends across the cabin. The midpoint of the base edge is tied overhead to form the apex and to define the triangular forward face, and the remaining corners of the sheet at the intersection of the base edge and the side edges are tied aft and to each side of the boat to form the port and starboard triangular faces. The sheet is preferably made of transparent vinyl and the edges reinforced with thin strips of canvas or the like. In addition to being easily deployable and providing a significant level of protection from the elements, the dodger may be rolled up and conveniently stowed when not in use.

13 Claims, 2 Drawing Sheets

DEMOUNTABLE COVER FOR A BOAT HATCHWAY OR THE LIKE

BACKGROUND OF THE INVENTION

The present invention relates to a protective cover for the open hatchway of a boat and, more particularly, to an easily deployable and demountable dodger to protect the forward end of the cockpit and the companionway in the cabin of a sailboat when docked or operating into the weather.

Dodgers are well known in the art of sailing and cruising as structures utilized to keep rain, spray and wind out of the open cockpit of a sailboat or power boat. Dodgers have been found to be particularly useful to protect a sailor standing in the open companionway of a sailboat when motoring into the weather or when under sail. A dodger must of necessity be able to withstand high winds and the force of driving rain or spray. Therefore, a dodger is typically constructed with rigid supporting struts and brackets such that it may be folded to lie flat on the cabin top or other surface when not in use. The flexible cover typically comprises a composite of a transparent plastic and reinforcing canvas to provide a combination of good visibility and needed strength. However, dodgers typical of the prior art are permanently installed and, when not needed or in use, are both unsightly and inconveniently located such that they detract substantially from the appearance and functionality of the boat.

To avoid the inconvenience and cost of a custom-made, permanently installed dodger, many sailors have attempted to rig temporary protective covers of various shapes and materials which would provide some measure of protection when needed, but could be removed and stowed when not required. Small tent-like covers or awnings have been rigged from a sheet of canvas or the like. Though these devices may provide some measure of protection, they typically are cumbersome and obstruct the vision of the sailor and, therefore, are not useful when underway.

As a result, there is a real need for a protective cover or dodger for the hatchway or companionway of a boat which may be easily and quickly deployed in foul weather, which provides protection when docked or at anchor as well as when underway, either motoring or under sail, and which can be easily taken down and stowed when not in use. Such a device should also be adaptable for use on a variety of styles and sizes of boats. Finally, the device should be of relatively low cost and not require the installation of any permanent supporting structure.

SUMMARY OF THE INVENTION

In accordance with the present invention, an easily deployable dodger which provides a protective cover for the hatchway on a boat is made from a generally trapezoidal shaped sheet of flexible material, at least a portion of which is transparent. Means for mounting the sheet to the boat are attached to each of the corners of the sheet and at the midpoint of its long base edge. Additional connecting means are provided for separately connecting each of the mounting means to the boat in a manner such that the midpoint of the base edge of the sheet forms the upper apex of an aft-opening pyramidal shape, and the other edges of the sheet form the lower edges of three adjacent faces of the pyramid, which faces are inclined forwardly and abeam from the apex to provide substantially enclosed protective cover.

Preferably, the sheet comprises a continuous piece of transparent plastic, such as clear vinyl, and is provided with narrow strips of reinforcing material along each of the edges of the sheet. The reinforcing strips may conveniently be made of canvas and sewn to the sheet edges with continuous stitching. In an alternate construction, intermediate strips of reinforcing material may be sewn to the sheet to extend between the midpoint of the base edge and the corners of the sheet defining the opposite edge. These optional intermediate strips then lie on the common edges between the center face of the pyramidal shape and its opposite adjacent faces.

The mounting means on the corners and midpoint of the base edge preferably comprise conventional metal grommets. The connecting means used to secure the sheet to the boat at the point of each of the grommets may conveniently comprise a short length of cord tied at one end to the grommet and at the other end to any convenient support.

In the preferred application of the present invention as a dodger for the open companionway in the cabin of a sailboat, the trapezoidal shaped sheet of edge-reinforced clear vinyl includes the corner grommets and additional grommet at the midpoint of the base edge, as previously described. Suitable connecting means, such as individual lengths of cord, are provided for each grommet. The aft-opening pyramidal shape is formed having three interconnected triangular faces including a forward face and oppositely adjacent port and starboard faces. The lower edge of the forward face is defined by the edge of the sheet opposite the base edge, which opposite edge is secured by its corner grommets to extend abeam of the cabin top just forward of the companionway. These two forward grommets, at the corners between the opposite edge and side edges of the sheet may be secured to the cabin top in any convenient manner as to grab rails or the like. The midpoint of the base edge is supported above and aft of the opposite edge to form the apex of the pyramid and the side edges of the sheet form the lower edges of the port and starboard faces of the pyramid. The midpoint of the base edge may be supported by tying the grommet to the boom of the boat or, if underway, by tying it with a longer cord to the back stay. The lower rear grommets at the corners of the base edge and side edges may be attached downwardly and rearwardly to any convenient attachment point, such as a safety line, side rail, cockpit coaming, or the like. Depending on the construction of the boat, forward grommets (and possibly the aft grommets) could be replaced with snaps or some other type of demountable fastener.

When not in use, the sheet may be rolled into a cylindrical tubular shape for each storage. Preferably, the sheet is rolled around a hollow cylindrical tube and the tube and rolled up sheet are inserted and stowed in a similarly shaped duffle bag.

DETAILED DESCRIPTION OF THE PREFERRED EMBODIMENT

Figure 1:
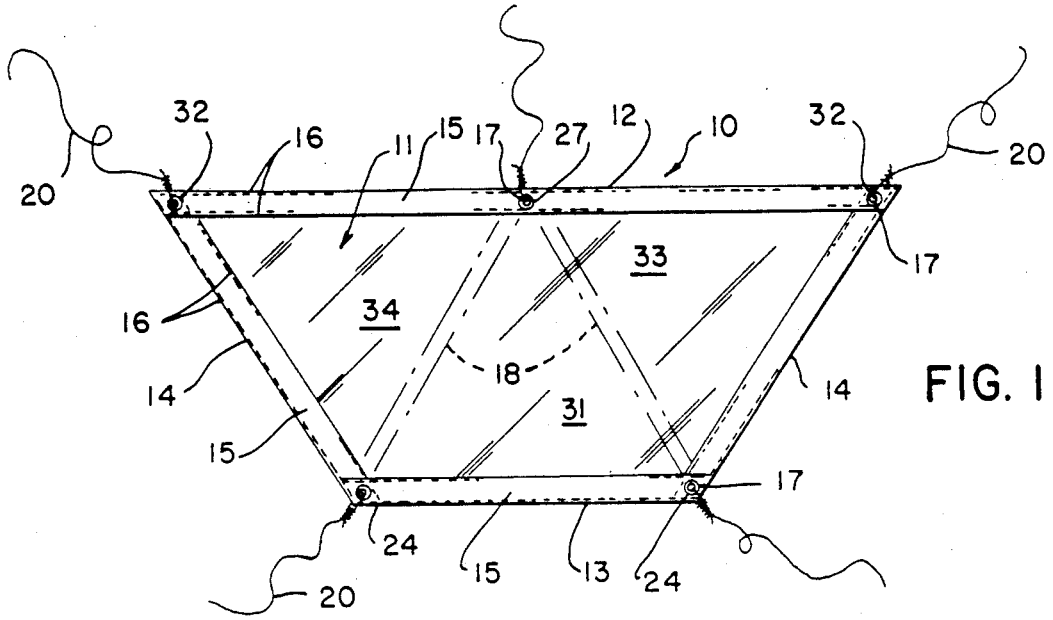
FIG. 1 is a plan view of the preferred embodiment of the protective cover of the present invention.

Referring initially to FIG. 1, the protective cover or dodger 10 of the present invention is made from a sheet 11 of transparent vinyl (or similar flexible transparent plastic) which is cut into the shape of a trapezoid as shown. The trapezoidal sheet is bounded by a base edge 12, a shorter opposite edge 13 and two side edges 14. A size that has been found to be adaptable to a wide variety of boat types and sizes has a base edge 11 feet long and a trapezoid height of 4½ feet. The opposite edge 13 and side edges 14 are of approximately equal lengths and each is about one-half the length of the base edge. In this manner, the sheet, when deployed, defines three generally equilateral triangular faces which form three faces of an open sided pyramid, as will be described in greater detail hereinafter.

Figure 5:
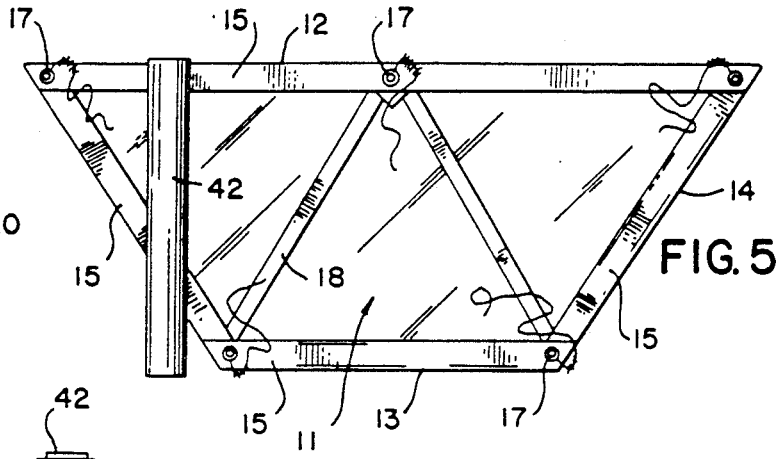
FIG. 5 is a plan view similar to FIG. 1, but showing the slightly modified construction of FIG. 2, and additionally showing the device used for rolling and storing the cover.

The edges of the sheet 11 are provided with continuous reinforcing strips 15. Each of the strips 15 extends the full length of the edge to which it is attached and may comprise a single layer or, preferably, a double layer folded along the edge and sewn through the vinyl sheet 11 with parallel spaced continuous stitching 16. The sheet 11 may optionally be provided with intermediate reinforcing strips 18 (shown in phantom in FIG. 1) extending between the midpoint of the base edge 12 and the corners defined by the opposite edge 13 and adjacent side edges 14. The optional intermediate reinforcing strips 18 are shown in the embodiment of FIGS. 2, 3 and 5.

To provide means for mounting the sheet to the boat, a grommet 17 is attached to each of the corners and to the midpoint of the base edge 12. The grommets 17 are attached within the reinforcing strips 15 in a conventional manner. For corrosion resistance, the grommets are preferably made of brass. A short piece of cord 20, such as ⅛ inch nylon, is attached to each grommet 17 to provide convenient means for connecting the sheet to the boat to form the uniquely shaped protective dodger.

Figure 2:
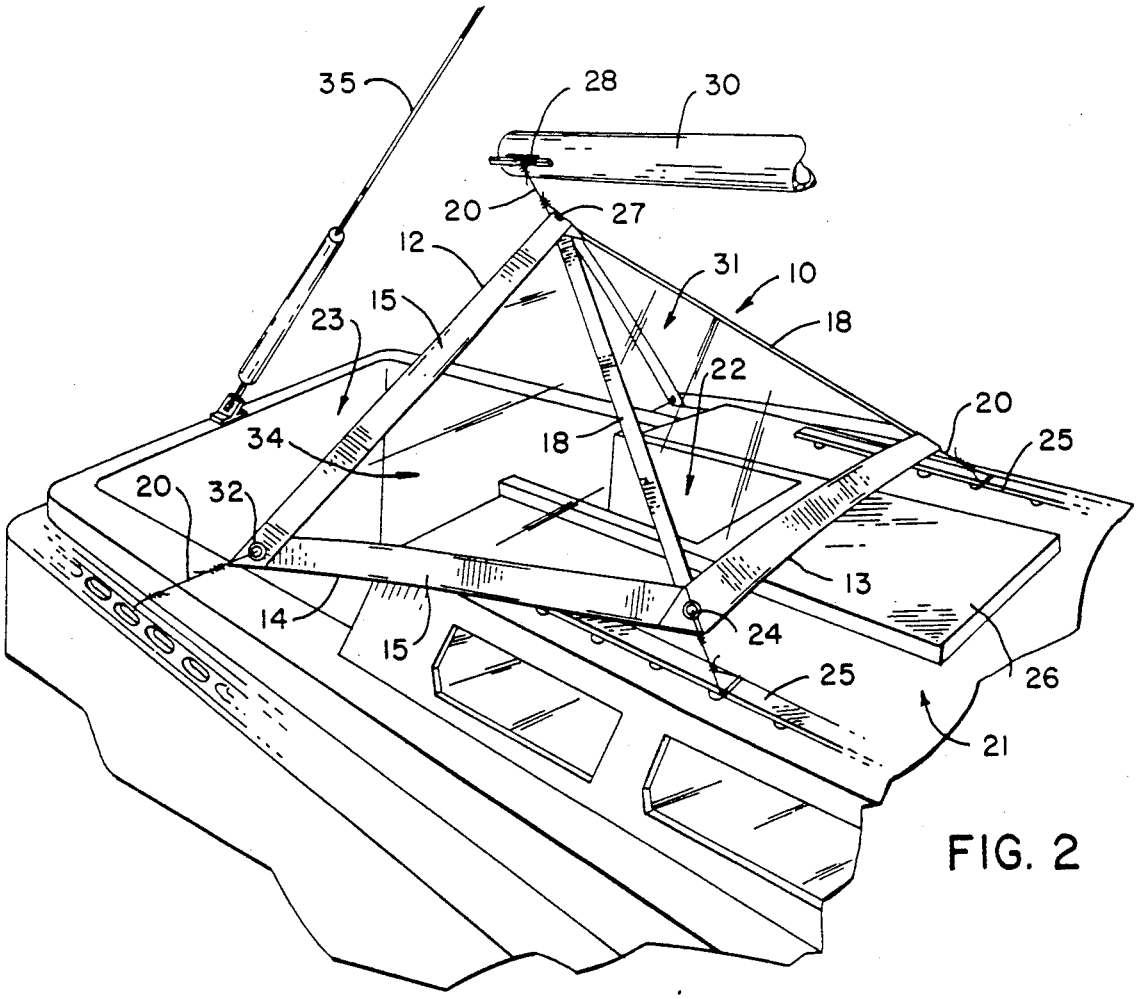
FIG. 2 is a perspective view of a portion of a sailboat, looking generally aft, showing deployment of the protective cover in a slightly modified embodiment.
Figure 3:
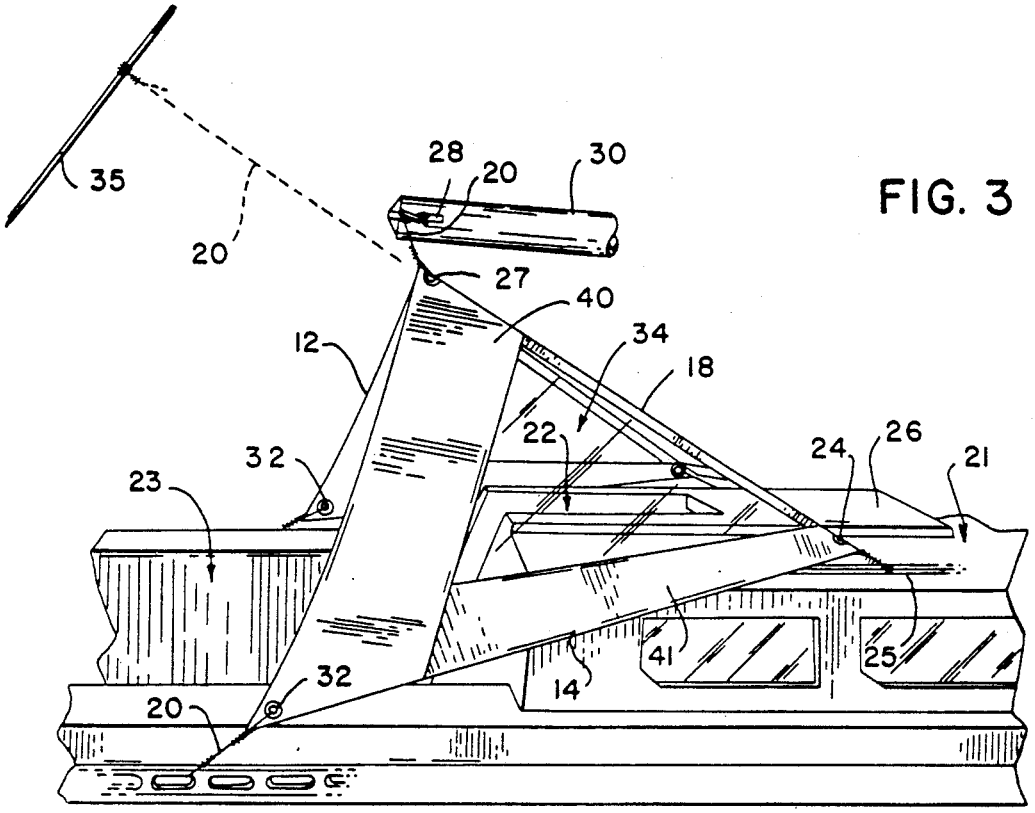
FIG. 3 is a perspective side view, similar to FIG. 2, but showing another embodiment of the protective cover.

In the specific application shown in FIGS. 2 and 3, the dodger is deployed over the aft end of the cabin 21 above the companionway 22 and extending rearwardly over a portion of the cockpit 23. The cords 20 attached to the two forward grommets 24 at opposite ends of edge 13 are tied to the top of the cabin 21 in any convenient manner, such as to grab rails 25. The cords 20 are tied so as to hold the edge 13 of the sheet in tension and down over the hatch cover housing 26 such that the edge 13 extends abeam of the cabin top and just forward of the open companionway 22. The cord 20 attached to the center grommet 27 at the midpoint of the base edge 12 is tied overhead in a manner to place the sheet in tension generally along the two lines from the forward grommets 24 through the center grommet 27. Most conveniently, the cord 20 from the center grommet 27 may be tied to a cleat 28 attached to the aft end of the boom 30. In its secured position, the midpoint of the base edge 12 at the center grommet 27 forms the apex of the pyramid and the portion of the sheet defined by the forward opposite edge 13 and the two intermediate reinforcing strips 18 forms the forward triangular face 31 of the pyramid. If the sheet of the preferred embodiment shown in FIG. 1 is used which has no intermediate reinforcing strips, angled edges will be formed along the same lines when the dodger is deployed. The short cord sections 20 attached to the aft grommets 32 at the corners of the base edge 12 and side edges 14 are similarly tied to some convenient point in a manner to impose a downward and rearward tension in the sheet and, in particular, to place the intersecting base edge and side edges at the aft grommets 32 in tension. The result is formation of identical triangular port and starboard faces 33 and 34, respectively, of the pyramid sharing the common apex with forward face 31. As shown, the aft grommets 32 may be tied to the port and starboard side rails, but any other convenient support may be utilized. When the cords 20 are ties as indicated to maintain the edges or edge portions of the sheet in tension, the various triangular faces 30, 33 and 34 will also be maintained flat and planar. The pyramid shape which results is, of course, aft-opening as shown. In other words, the dodger, when deployed, forms a generally square or somewhat trapezoidal-based pyramid having three closed faces forward and to both sides and one open face to the rear.

Figure 4:
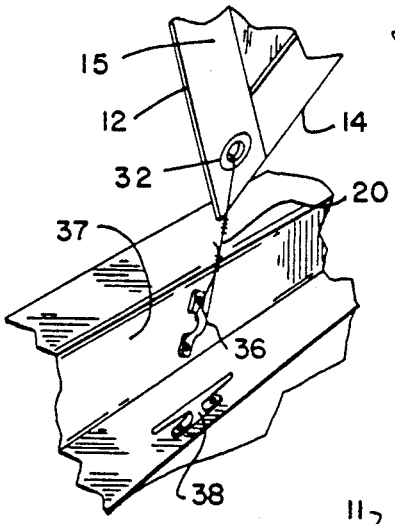
FIG. 4 is a detailed perspective view of the cover mounting means and one manner of connecting the same to the boat.

As already indicated, the cords 20 attached to each of the grommets may be tied in any convenient manner to any suitable support. If the boat is under sail, the cord 20 from the center grommet 27 forming the apex of the pyramid may be tied to the back stay 35. Referring also to FIG. 4, the cords attached to the aft grommets 32 may be tied to padeyes 36 attached to the cockpit coaming 37 on the port and starboard sides. Alternately, a nearby cleat 38 may also be utilized. It is also possible to replace the forward grommets 24, and possibly the aft grommets 32 as well, with snap fasteners, the mating portions of which would be suitably attached to the cabin 21, coaming 37 or wherever appropriate to maintain the overall structure in tension as previously indicated.

The embodiment of the dodger shown in FIG. 3 includes a substantially widened reinforcing strip 40 along the base edge 12 and a pair of tapered reinforcing strips 41 along the side edges 14. This provides a sleeker and more stylish appearance to the dodger and yet retains adequate window surface in the triangular faces 31, 33 and 34.

Figure 6:
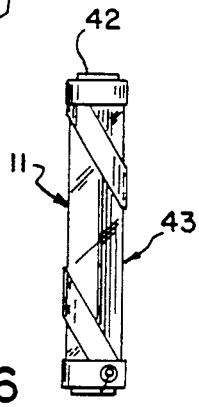
FIG. 6 is a side elevation of the FIG. 5 assembly after the same has been rolled up for storage.
Figure 7:
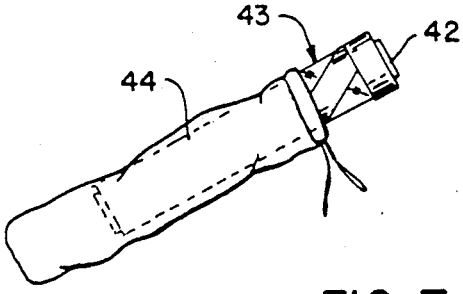
FIG. 7 shows the rolled assembly of FIG. 6 being inserted into a storage bag.

In the embodiment shown, the dodger provides virtually complete cover for the companionway 22 and also extends aft far enough to cover at least the forward end of the cockpit 23. This has been found to be particularly desirable when sailing or motoring into the weather to provide protection for the pilot and crew standing in this area. When no longer needed, the dodger is easily demountable by simply untying the cords 20. As shown in FIGS. 5–7, the sheet 11 is laid flat and rolled around a hollow cylindrical tube 42 to form a compact roll 43. The tube 42 may be made of any suitable material, such as cardboard or plastic, and is preferably about 6 inches in diameter and about as long as the height of the trapezoidal sheet 11. The roll 43 is preferably stowed in a cylindrical duffle bag 44 of appropriate size which may be tied shut for convenient storage. The duffle bag may be made of canvas, acrylic cloth, or any other suitable material.

The protective dodger made from the sheet 11 of the approximate size and shape described herein is adaptable for attachment to boats of widely varying designs. In addition to the protection it provides, the dodger does not inhibit ready access to the cabin or forward deck areas, allows visibility of the full horizon while underway, permits the companionway hatch to be left open for ventilation while preventing the entry of spray and rain, and can be deployed and rigged quickly when needed.

Various modes of carrying out the present invention are contemplated as being within the scope of the following claims particularly pointing out and distinctly claiming the subject matter which is regarded as the invention.

I claim:

1. An easily deployable dodger to provide a protective cover for a hatchway on a boat comprising:

a generally trapezoidal shaped sheet of flexible material, at least a portion of which is transparent;

mounting means attached to each of the corners of said sheet and at the midpoint of its base edge; and, means for separately connecting each of said mounting means to the boat such that the midpoint of said base edge defines the uppermost point of said sheet and forms the apex of an aft-opening pyramidal shape and the other edges of said sheet form the lower edges of three adjacent faces of said pyramidal shape.

2. The apparatus as set forth in claim 1 wherein said sheet comprises a continuous piece of transparent plastic.

3. The apparatus as set forth in claim 2 wherein said sheet includes narrow strips of reinforcing material along each of the edges of the sheet.

4. The apparatus as set forth in claim 3 including intermediate strips of reinforcing material extending between the midpoint of said base edge and the corners defining the edge opposite said base edge.

5. The apparatus as set forth in claim 3 wherein said reinforcing strips are attached in a continuous manner along said sheet edges.

6. The apparatus as set forth in claim 5 wherein said transparent plastic material is vinyl and said reinforcing material is canvas.

7. The apparatus as set forth in claim 5 wherein said mounting means comprises metal grommets.

8. The apparatus as set forth in claim 7 wherein said connecting means comprises a demountable connector for each grommet.

9. A demountable protective cover for the open companionway in the cabin of a sailboat, said protective cover comprising:

a sheet of flexible plastic material of generally trapezoidal shape defined by a base edge, a shorter opposite edge, and a pair of side edges connecting said base and opposite edges, a substantial portion of which sheet is transparent;

flexible reinforcing means extending continuously along the edges of said sheet;

mounting means on each of the corners of said sheet and at approximately the midpoint of said base edge;

means for separately connecting each of said mounting means to the boat whereby said sheet assumes an aft-opening pyramidal shape having three interconnected triangular faces comprising a forward face and oppositely adjacent port and starboard faces;

said sheet being positioned such that the midpoint of said base edge forms the upper apex of said pyramidal shape, said opposite edge forms the lower edge of said forward face and extends abeam of the cabin top forward of the companionway, and said side edges form the lower edges of said port and starboard faces.

10. The protective cover as set forth in claim 9 wherein said connecting means are disposed to maintain the edges of sheet in tension.

11. The cover as set forth in claim 10 wherein said edges are continuously reinforced.

12. The cover as set forth in claim 11 wherein said mounting means comprises open grommets and said connecting means comprises a length of cord for each grommet.

13. The cover as set forth in claim 12 wherein the grommets at the forward corners are tied by their respective cords to the cabin, the grommet at the midpoint of the base edge is tied by its cord to an overhead support, and the grommets at the aft corners are tied by their respective cords to opposite sides of the boat.

* * * * *